US011719081B2

(12) United States Patent
Lu et al.

(10) Patent No.: US 11,719,081 B2
(45) Date of Patent: Aug. 8, 2023

(54) METHOD FOR INTEGRAL PROFILE CONTROL AND PLUGGING OF WATER ENCROACHMENT AND STEAM CHANNELING OF HEAVY OIL RESERVOIR WITH EDGE AND BOTTOM WATER

(71) Applicant: CHINA UNIVERSITY OF PETROLEUM, Qingdao (CN)

(72) Inventors: Teng Lu, Qingdao (CN); Zhaomin Li, Qingdao (CN); Binfei Li, Qingdao (CN); Songyan Li, Qingdao (CN)

(73) Assignee: CHINA UNIVERSITY OF PETROLEUM, Qingdao (CN)

( * ) Notice: Subject to any disclaimer, the term of this patent is extended or adjusted under 35 U.S.C. 154(b) by 55 days.

(21) Appl. No.: 17/596,156

(22) PCT Filed: Apr. 30, 2020

(86) PCT No.: PCT/CN2020/088123
§ 371 (c)(1),
(2) Date: Dec. 3, 2021

(87) PCT Pub. No.: WO2020/248740
PCT Pub. Date: Dec. 17, 2020

(65) Prior Publication Data

US 2022/0316305 A1 Oct. 6, 2022

(30) Foreign Application Priority Data

Jun. 10, 2019 (CN) ..... 201910497614.8

(51) Int. Cl.
*E21B 43/24* (2006.01)
*E21B 43/16* (2006.01)

(52) U.S. Cl.
CPC ..... *E21B 43/24* (2013.01); *E21B 43/166* (2013.01)

(58) Field of Classification Search
CPC ..... E21B 43/24; E21B 43/166
USPC ..... 166/272.5
See application file for complete search history.

(56) References Cited

U.S. PATENT DOCUMENTS 5,042,583 A * 8/1991 D'Souza ..... E21B 43/24 166/272.5
8,701,770 B2 * 4/2014 Schultz ..... E21B 41/0042 166/50
9,429,004 B2 * 8/2016 Affholter ..... E21B 43/247
(Continued)

*Primary Examiner* — William D Hutton, Jr.
*Assistant Examiner* — Ashish K Varma
(74) *Attorney, Agent, or Firm* — CBM PATENT CONSULTING, LLC

(57) ABSTRACT

Disclosed is a method for performing integral plugging control on water invasion and steam channeling of an edge-bottom water heavy oil reservoir. The method for performing integral plugging control on water invasion and steam channeling of an edge-bottom water heavy oil reservoir comprises the following steps: (1) selecting an oil reservoir; (2) arranging a huff-puff well; (3) performing steam huff-puff development; and (4) performing integral plugging control. An integral plugging control technology is used for the method, a high-strength nitrogen foam system is injected by means of well rows at different positions in the oil reservoir, and effective plugging walls are formed at different positions from the edge-bottom water to reduce water invasion and steam channeling.

8 Claims, 3 Drawing Sheets

(56) References Cited

U.S. PATENT DOCUMENTS

2017/0137704 A1* 5/2017 Mazyar ..... E21B 43/24
2020/0400001 A1* 12/2020 Kibodeaux ..... E21B 43/168

* cited by examiner

METHOD FOR INTEGRAL PROFILE CONTROL AND PLUGGING OF WATER ENCROACHMENT AND STEAM CHANNELING OF HEAVY OIL RESERVOIR WITH EDGE AND BOTTOM WATER

FIELD OF THE INVENTION

The present disclosure belongs to the technical field of oil and gas field development, and particularly relates to a method for integral profile control and plugging of water encroachment and steam channeling of a heavy oil reservoir with edge and bottom water.

BACKGROUND OF THE INVENTION

Heavy oil refers to crude oil having a viscosity of more than 50 mPa s under oil layer conditions or having a viscosity of more than 100 mPa s in the form of stock tank oil at an oil layer temperature and a relative density of more than 0.92. A predicted stock size of the heavy oil in China is about 198×108 t. With the increasing difficulty in exploration and development of conventional thin oil reservoirs, further increasing the yield of the heavy oil is an important guarantee to maintain the stability of domestic oil production and national energy security.

At present, the oil yield through cyclic steam stimulation accounts for more than 70% of heavy oil yield. However, for the heavy oil reservoirs containing edge and bottom water, with the increase of steam huff-puff cycles, the formation energy in the heavy oil reservoirs is reduced gradually. Without external energy supplement, the bottom of huff-puff wells may have a pressure deficit, and the edge and bottom water may encroach into the oil layer under the action of pressure difference, resulting in water flooding in the oil layer and rapid increase of moisture content, which may affect the development effect. At the same time, in the oil layer, with the increase of huff-puff cycles, steam channeling channels are formed between the huff-puff wells, which may also affect the development effect of cyclic steam stimulation.

Therefore, after multiple cycles of cyclic steam stimulation in the heavy oil reservoir with the edge and bottom water, the water encroachment and steam channeling are serious, and the cyclic steam stimulation effect is worsened.

SUMMARY OF THE INVENTION

An objective of the present disclosure is to provide a method for integral profile control and plugging of water encroachment and steam channeling of a heavy oil reservoir with edge and bottom water, in order to solve the above problems. The method adopts an integral profile control and plugging technology to inject a high-intensity nitrogen foam system and a nitrogen foam system to well rows at different positions in the oil reservoir to form effective plugging walls at different positions away from the edge and bottom water, thereby slowing down the water encroachment and steam channeling.

The technical solution of the present disclosure is as follows: a method for integral profile control and plugging of water encroachment and steam channeling of a heavy oil reservoir with edge and bottom water includes the following steps:

(1) selecting an oil reservoir: roughly screening an appropriate oil reservoir according to the following conditions: the oil reservoir is a heavy oil reservoir with edge and bottom water, the viscosity of stock tank oil at 50° C. is less than 100000 mPa·s, a buried depth of the oil reservoir is less than 1000 m, an effective thickness is greater than 5 m, an initial oil bearing saturation is greater than 0.5, a penetration rate is greater than 200 mD, and a volume ratio of water body to oil layer is less than 500;

(2) arranging huff-puff wells: drilling the huff-puff wells in the oil layer according to a row-well pattern, the huff-puff wells being vertical or horizontal wells; determining the number of well rows according to an area of the oil reservoir, at least 3 columns of huff-puff well rows being arranged in the oil layer, a distance between two adjacent columns of well rows being 100-150 m, a distance between two adjacent huff-puff wells in each column of well rows being 100-150 m, one column of well rows close to a water body being a first line of well rows, followed by a second line of well rows and a third line of well rows, and so on, and a distance between the first line of well rows and the water body being greater than 150 m;

(3) developing through cyclic steam stimulation: firstly beginning a first cycle of cyclic steam stimulation, a steam injection volume for the first line of well rows being 1000-1200 t, a steam injection volume for the second line of well rows being 1500-1800 t, and a steam injection volume for the third line of well rows being 2000-2200 t; after the steam injection, soaking the wells for 3-5 days, and after the soaking, opening the wells for production, a ratio of a fluid output of the first line of well rows to a cold water equivalent volume of the injected steam being less than 5, a ratio of a fluid output of the second line of well rows to a cold water equivalent volume of the injected steam being less than 10, a ratio of a fluid output of the third line of well rows to a cold water equivalent volume of the injected steam being less than 20, and huff-puff parameters of a next cycle being consistent with those of the first cycle;

(4) carrying out the integral profile control and plugging: with the increase of huff-puff cycles, the formation pressure drops gradually, water encroachment and steam channeling occur, an integral profile control and plugging technology is adopted, and specific operations are as follows:

1) after a moisture content of the first line of well rows is greater than 90%, injecting a high-intensity nitrogen foam system at the same time of a steam injection phase of the first line of well rows, reducing a cyclic steam injection volume of the first line of well rows to 800-1000 t, injecting nitrogen with the steam in a whole process, an injection volume being calculated according to a gas-to-liquid ratio of foam formed downhole of 2:1; and after soaking the wells for 3-5 days, carrying out oil recovery;

2) injecting a nitrogen foam system at the same time of steam injection of the second line of well rows, a concentration of a foaming agent being 0.5%, and a steam injection volume of the second line of well rows being 1500-1800 t; injecting the nitrogen with the steam in the whole process, a nitrogen injection volume being calculated according to a gas-to-liquid ratio of the foam formed downhole of 3:1; and after the steam injection is finished, increasing well soaking time to 5-6 days, and then opening the wells for production; and 3) injecting the nitrogen foam system at the same time of the steam injection of the third line of well rows, the concentration of the foaming agent being 0.5%, and a steam injection volume of the third line of well rows being 1500-2500 t; injecting the nitrogen with the steam in the whole process, the nitrogen injection volume being calculated according to a gas-to-liquid ratio of the foam formed downhole of 4:1; and after the steam injection is finished, increasing the well soaking time to 6-8 days, and then opening the wells for production.

The high-intensity nitrogen foam system in the step (4) adopts a solid particle reinforced foam system or a high-temperature resistant gel foam system.

A concentration of solid particles in the solid particle reinforced foam system is 0.5%-1%, and a concentration of the foaming agent is 0.5%.

The solid particles in the solid particle reinforced foam system adopt coal ash, clay particles or nano particles.

The high-temperature resistant gel foam system includes a high-temperature resistant gel plugging agent injected into a formation and nitrogen foam injected at the same time of the cyclic steam stimulation.

The high-temperature resistant gel plugging agent adopts tanning extracts or temperature-sensitive gel.

An injection amount of the high-temperature resistant gel plugging agent is 30-50 t.

The concentration of the foaming agent in the high-temperature resistant gel foaming system is 0.5%.

The present disclosure has the beneficial effects that according to the method for integral profile control and plugging of water encroachment and steam channeling of the heavy oil reservoir with edge and bottom water, with the increase of huff-puff cycles, the formation pressure drops gradually, which may lead to water encroachment and steam channeling; the method adopts the integral profile control and plugging technology, and the high-intensity nitrogen foam system and the nitrogen foam system are separately injected into the well rows at different positions in the oil reservoir to form effective plugging walls at different positions away from the edge and bottom water, which can slow down the water encroachment and steam channeling, so that the moisture content is reduced by 10%-15%, and an oil-steam ratio is increased by 0.2%-0.5%, thereby integrally improving the development effect of the multi-cycle cyclic steam stimulation of the heavy oil reservoir with the edge and bottom water.

To realize the integral profile control and plugging, at least 3 columns of huff-puff well rows are arranged in an oil layer, and a distance between the well rows is designed; and a distance between a first line of well rows and the water body is greater than 150 m, if the distance is less than 150 m, the cyclic steam stimulation development of the first line of well rows easily causes communication with the edge and bottom water, resulting in rapid encroachment of the water body, and affecting the development effect. The distance between two adjacent columns of well rows is 100-150 m, and the distance between two adjacent huff-puff wells in each column of well rows is 100-150 m. Three types of well rows have different distances from the edge and bottom water, and different types of technologies may be carried out in sequence, so that an effect on slowing down the water encroachment and steam channeling can be achieved.

In the method, a relationship between the injected steam volume and the fluid output of the huff-puff wells and an equivalent cold water volume of the injected steam is designed; the first line of well rows is closer to the water body, the excess steam injection volume may lead to communication with the water body; and the second line and third line of well rows are gradually further to the water body, so that the steam injection volume is increased gradually. The ratio of the fluid output of the first line of well rows to the equivalent cold water volume of the injected steam shall be less than 5, otherwise, if the production time of the first line of well rows is long, and the fluid output is excessively high, the rapid encroachment of the water body may be caused; and the ratio of the fluid output of the second line of well rows to the cold water equivalent volume of the injected steam shall be less than 10, otherwise, if the production time of the second line of well rows is long, and the fluid output is too high, the rapid encroachment of the water body may also be caused. The ratio of the fluid output of the third line of well rows to the equivalent cold water volume of the injected steam shall be less than 20, otherwise, if the production time of the third line of well rows is long, and the fluid output is excessively high, the rapid encroachment of the water body may also be caused; and the huff-puff parameters of a next cycle are consistent with those of the first cycle.

DETAILED DESCRIPTION OF THE EMBODIMENTS

The present disclosure is described in detail below in combination with embodiments.

Embodiment 1

Figure 1:
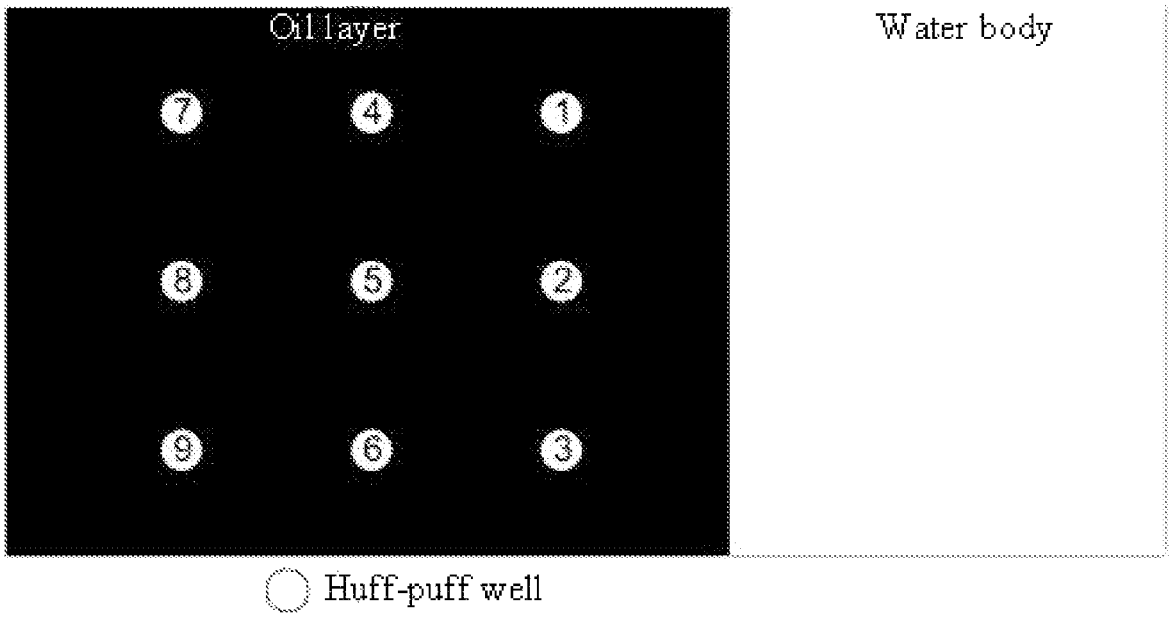
FIG. 1 is a layout schematic diagram of huff-puff wells in a specific implementation of the present disclosure.

A method for integral profile control and plugging of water encroachment and steam channeling of a heavy oil reservoir with edge and bottom water includes the following steps:

(1) An oil reservoir is selected: a block is a heavy oil reservoir with edge and bottom water, an oil containing area is 6.0 $km^2$, a viscosity of stock tank oil at 50° C. is 3983 mPa s, a buried depth of the oil reservoir is 940 m, an effective thickness is 7 m, an initial oil bearing saturation is 0.65, a penetration rate is 2520 mD, and a volume ratio of a water body to an oil layer is 350;

(2) Huff-puff wells are arranged: the huff-puff wells are drilled in the oil layer according to a row-well pattern, the huff-puff wells are horizontal wells; the number of well rows is determined according to an area of the oil reservoir; 3 columns of huff-puff well rows are arranged in the oil layer; as shown in FIG. 1, the well rows closest to the water body are a first line of well rows (#1, #2 and #3), the well rows further to the water body are a second line of well rows (#4, #5 and #6), and the well rows furthest to the water body are a third line of well rows (#7, #8 and #9); a distance between the first line of well rows and the water body is 200 m; a distance between two adjacent columns of well rows is 150 m; and a distance between two adjacent huff-puff wells in each column of well rows is 150 m.

(3) The development is carried out with cyclic steam stimulation: a first cycle of cyclic steam stimulation is begun firstly; a steam injection volume of the first line of well rows is 1200 t, a steam injection volume of the second line of well rows is 1800 t, and a steam injection volume of the third line of well rows is 2000 t; after the steam injection, the wells are soaked for 3 days, and after the well soaking, the wells are opened for production; when a ratio of a fluid output of the first line of well rows to a cold water equivalent volume of the injected steam is 4.5, the wells are shut in, that is, the fluid output of the first line of well rows is 5400 $m^3$; when a ratio of a fluid output of the second line of well rows to a cold water equivalent volume of the injected steam is 8, the wells are shut in, that is, the fluid output of the second line of well rows is 14400 $m^3$. When the ratio of the fluid output of the third line of well rows to the cold water equivalent volume of the injected steam is 15, the wells are shut in, that is, the fluid output of the third line of well rows is 30000 $m^3$; and then a next cycle of cyclic steam stimulation is carried out, and the huff-puff parameters of the next cycle are consistent with those of the first cycle. When an oil recovery volume is less than 1 ton/day, the wells are shut in; and then the next cycle of cyclic steam stimulation is carried out, and the huff-puff parameters of the next cycle are consistent with those of the first cycle.

Figure 2:
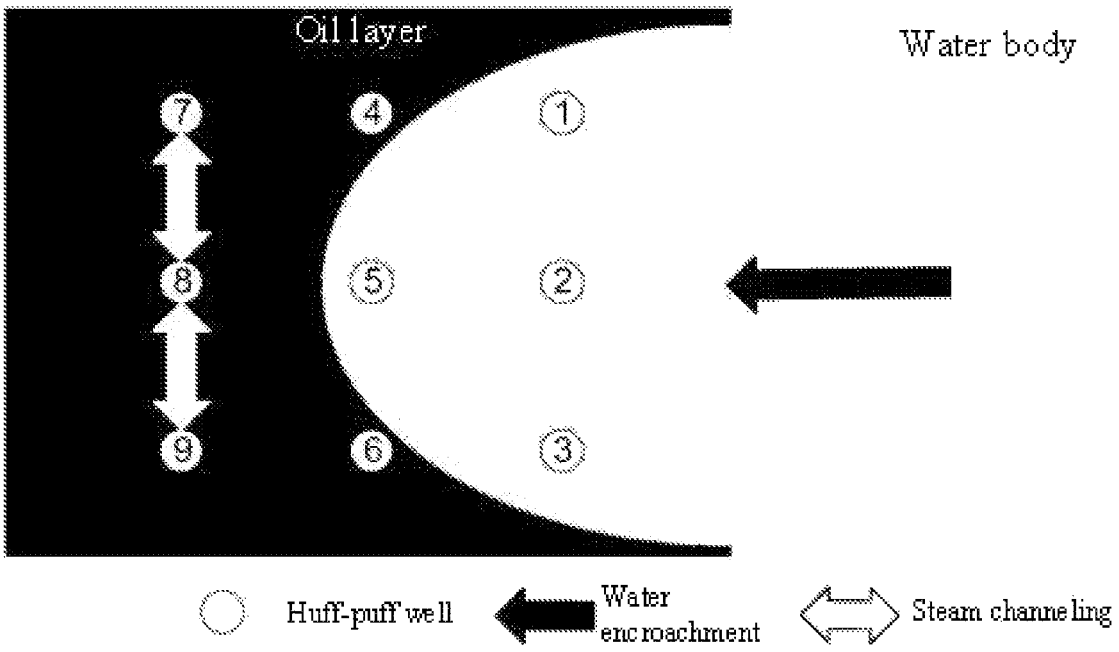
FIG. 2 is a schematic diagram of occurrence of water encroachment and steam channeling in a specific implementation of the present disclosure.

(4) Integral profile control and plugging is carried out: as shown in FIG. 2, with the increase of huff-puff cycles, the formation pressure drops gradually, and the water encroachment and steam channeling occur, so that the high-pressure edge and bottom water may encroach into the oil layer, the steam injected into the first line of well rows (#1, #2 and #3) that are closest to the water body is easily communicated with the edge and bottom water to form a water encroachment channel, which may result in rapid increase of the moisture content of the first line of well rows. The second line of well rows (#4, #5 and #6) that have a second distance to the edge and bottom water may also be affected by the water encroachment, which is reflected on the increase of the moisture content. Under the energy supplement of the edge and bottom water, the formation pressure of the first line and second line of well rows does not drop obviously; the third line of well rows (#7, #8 and #9) are furthest to the edge and bottom water, so that the moisture content increases slowly; however, there is no energy supplement of water body, the bottom-hole pressure of the third line of well rows drops rapidly, so that the steam injected into the third line of well rows easily forms steam channeling under the impact of formation heterogeneity, and the wells #7, #8 and #9 all have the steam channeling; a large amount of injected steam is channeled in the formation, affecting the development effect; therefore, the water encroachment and the steam channeling may greatly affect the multi-cycle cyclic steam stimulation development of the oil reservoir with edge and bottom water.

Figure 3:
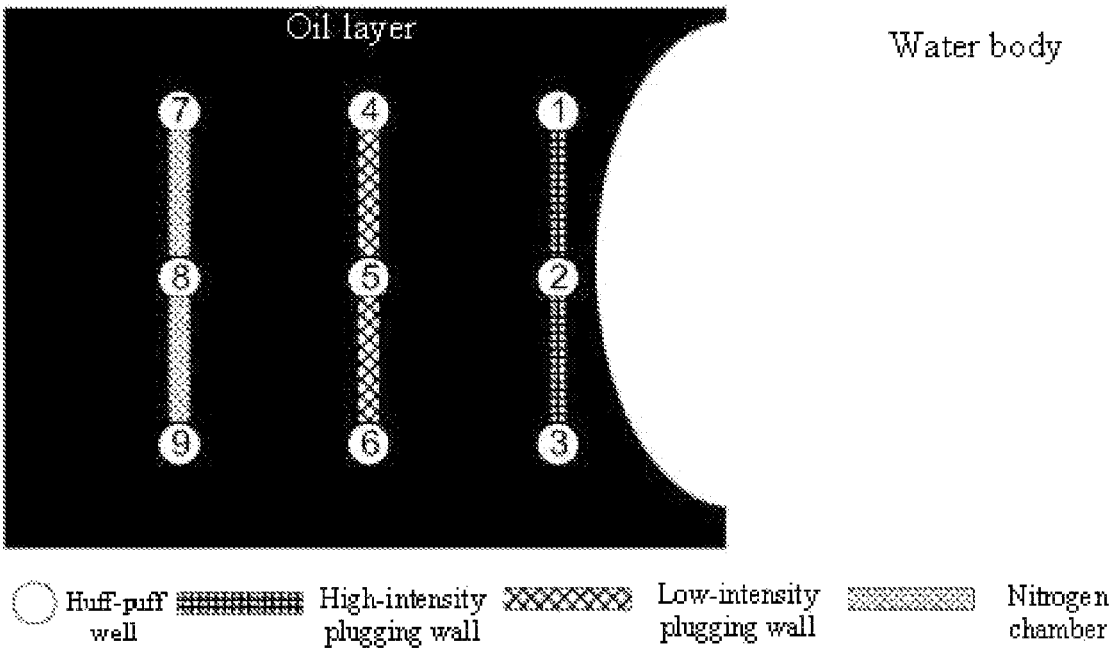
FIG. 3 is a schematic diagram of integral profile control and plugging in a specific implementation of the present disclosure.

The method adopts the integral profile control and plugging technology, specific operations of which are as follows:

1) After two huff-puff cycles of the first line of well rows (#1, #2 and #3), the moisture content is increased to 92% from preliminary 35%, and at the time, the water body completely encroaches into the first line of wells; in a steam injection phase of the third cycle of cyclic steam stimulation of the first line of well rows, a high-temperature resistant gel foam system is injected at the same time; and the high-temperature resistant gel foam system includes a high-temperature resistant gel plugging agent injected firstly into a formation and nitrogen foam injected at the same time of the cyclic steam stimulation. The high-temperature resistant gel plugging agent adopts tanning extracts. An injection amount of the high-temperature resistant gel plugging agent is 30 t; the nitrogen foam is injected at the same time of the steam injection; and a concentration of the foaming agent is 0.5%. A periodic steam injection volume of the first line of well rows is reduced to 800 t, the nitrogen is injected with the steam in the whole process, the injection volume is calculated according to a gas-to-liquid ratio of foam formed downhole of 2:1, and the calculated nitrogen injection volume is 96000 $m^3$; then after the wells are soaked for 5 days, oil recovery is carried out; and when a ratio of fluid output of the first line of well rows to a cold water equivalent volume of the injected steam is 5, the wells are shut in, that is, the fluid output of the first line of wells is 4000 $m^3$. The injected high-intensity nitrogen foam system may form high-intensity plugging walls in the first line of well rows; the high-intensity plugging walls may slow down the encroachment of the water body; and at the same time, the steam injection volume is reduced, so that the re-communication between the steam and the edge and bottom water can be prevented to avoid forming a water encroachment channel, as shown in FIG. 3.

2) After 2 huff-puff cycles of the second line of well rows (#4, #5 and #6), the moisture content is increased to 75% from the preliminary 21%; and the second line of well rows is also affected by the encroachment of the edge and bottom water. At the third cycle of the second line of well rows, a nitrogen foam system is injected at the same time of steam injection, and a concentration of a foaming agent is 0.5%; a steam injection volume of the second line of well rows is 1600 t, and the nitrogen is injected with the steam in the whole process; a nitrogen injection volume is calculated according to a gas-to-liquid ratio of the foam formed downhole of 3:1; and the nitrogen injection volume is 288000 $m^3$. The increase of the nitrogen injection volume may play a role in supplementing formation energy and slowing down the encroachment of the edge and bottom water; and after the steam injection is finished, the well soaking time is increased to 6 days, so that the increase of the well soaking time is conducive to the migration of the nitrogen to the deep of the formation, thereby increasing the flexible oil flooding energy of the nitrogen. Then the wells are opened for production; and when the ratio of the fluid output of the second line of well rows to the cold water equivalent volume of the injected steam is 8, the wells are shut in, that is, the fluid output of the second line of wells is 12800 $m^3$. The injected nitrogen foam may form low-intensity plugging walls in the second line of well rows, and the low-intensity plugging walls may further slow down the encroachment of the water body, as shown in FIG. 3.

3) The third line of well rows (#7, #8 and #9) are further to the edge and bottom water, so the impact of water encroachment is small, and the moisture content is less than 60%. However, the third line of well rows easily produces steam channeling due to rapid drop of formation pressure. The nitrogen foam system is injected at the same time of the steam injection, and the concentration of the foaming agent is 0.5%; the steam injection volume of the third line of well rows is 2500 t, the nitrogen is injected with the steam in the whole process, and the nitrogen injection volume is calculated according to a gas-to-liquid ratio of foam formed downhole of 4:1; the nitrogen injection volume is 600000 $m^3$; after the steam injection is finished, the well soaking time is increased to 8 days, and the increase of the well soaking time is conducive to the migration of the nitrogen to the deep of the formation; and then the wells are opened for production. When the ratio of the fluid output of the third line of well rows to the cold water equivalent volume of the injected steam is 10, the wells are shut in, that is, the fluid output of the third line of wells is 25000 $m^3$.

Through the integral profile control and plugging technology, the average daily oil yield is increased by 27 t/d, the average moisture content is reduced by 10.2%, the periodic oil-steam ratio is increased by 0.08, and a good effect for controlling the water encroachment and steam channeling is achieved.

Comparative Example 1

With the increase of the huff-puff cycles, the formation pressure drops gradually, and the water encroachment and steam channeling occur, so that the high-pressure edge and bottom water may encroach into the oil layer, the steam injected into the first line of well rows (#1, #2 and #3) that are closest to the water body is easily communicated with the edge and bottom water to form a water encroachment channel, which may result in rapid increase of the moisture content of the first line of well rows. After 2 huff-puff cycles of the first line of well rows (#1, #2 and #3), the average moisture content is increased to 92% from the preliminary 35%, and at the time, the water completely encroaches into the first line of wells; and after 2 huff-puff cycles of the second line of well rows (#4, #5 and #6), the average moisture content is increased to 75% from the preliminary 21%, and the second line of well rows is also affected by the encroachment of the edge and bottom water. Other steps are the same as those in the embodiment. The comparative example differs from the embodiment in that the local profile control and plugging is adopted for wells with serious water encroachment and steam channeling in the block, which is specifically as follows: the moisture content of #2 well in the first line of well rows reaches up to 94%, nitrogen foam profile control and plugging is implemented for the well, the nitrogen injection volume is 50000 $m^3$, and the steam injection volume is 1200 t; and the well soaking time is 3 days. However, after the production, the moisture content of the well still reaches up to 92%, and the moisture is not reduced, which indicates that if it is impossible to make overall layout and set conditions for integral profile control and regulation according to a specific situation of the well rows at different positions in the reservoir, it is impossible to form effective plugging walls at different positions away from the edge and bottom water only through the local profile control and plugging of the nitrogen foam, so that the encroachment of the edge and bottom water cannot be controlled effectively.

What is claimed is:

1. A method for integral profile control and plugging of water encroachment and steam channeling of a heavy oil reservoir with edge and bottom water, comprising the following steps:

(i) selecting an oil reservoir: roughly screening an appropriate oil reservoir according to the following conditions: the oil reservoir is a heavy oil reservoir with edge and bottom water, the viscosity of stock tank oil at 50° C. is less than 100000 mPa·s, a buried depth of the oil reservoir is less than 1000 m, an effective thickness is greater than 5 m, an initial oil bearing saturation is greater than 0.5, a penetration rate is greater than 200 mD, and a volume ratio of a water body to an oil layer is less than 500;

(ii) arranging huff-puff wells: drilling the huff-puff wells in the oil layer according to a row-well pattern, wherein the huff-puff wells are vertical or horizontal wells; determining the number of well rows according to an area of the oil reservoir, wherein at least 3 columns of huff-puff well rows are arranged in the oil layer, a distance between two adjacent columns of well rows is 100-150 m, and a distance between two adjacent huff-puff wells in each column of well rows is 100-150 m; one column of well rows close to water body is a first line of well rows, followed by a second line of well rows and a third line of well rows, and so on, and a distance between the first line of well rows and the water body is greater than 150 m;

(iii) developing through cyclic steam stimulation: firstly beginning a first cycle of cyclic steam stimulation, wherein a steam injection volume for the first line of well rows is 1000-1200 t, a steam injection volume for the second line of well rows is 1500-1800 t, and a steam injection volume for the third line of well rows is 2000-2200 t; after the steam injection, soaking the wells for 3-5 days, and after the soaking, opening the wells for production, wherein a ratio of a fluid output of the first line of well rows to a cold water equivalent volume of the injected steam is less than 5; a ratio of a fluid output of the second line of well rows to a cold water equivalent volume of the injected steam is less than 10; a ratio of a fluid output of the third line of well rows to a cold water equivalent volume of the injected steam is less than 20; and huff-puff parameters of a next cycle are consistent with those of the first cycle;

(iv) carrying out the integral profile control and plugging: with the increase of huff-puff cycles, the formation pressure drops gradually, water encroachment and steam channeling occur, an integral profile control and plugging technology is adopted, and specific operations are as follows:

(a) after a moisture content of the first line of well rows is greater than 90%, injecting a high-intensity nitrogen foam system at the same time of a steam injection phase of the first line of well rows, reducing a cyclic steam injection volume of the first line of well rows to 800-1000 t, injecting nitrogen with the steam in a whole process, wherein an injection volume is calculated according to a gas-to-liquid ratio of foam formed downhole of 2:1; and after soaking the wells for 3-5 days, carrying out oil recovery;

(b) injecting a nitrogen foam system at the same time of steam injection of the second line of well rows, wherein a concentration of a foaming agent is 0.5%; a steam injection volume of the second line of well rows is 1500-1800 t; injecting the nitrogen with the steam in the whole process, wherein a nitrogen injection volume is calculated according to a gas-to-liquid ratio of the foam formed downhole of 3:1; and after the steam injection is finished, increasing well soaking time to 5-6 days, and then opening the wells for production; and (c) injecting the nitrogen foam system at the same time of the steam injection of the third line of well rows, wherein the concentration of the foaming agent is 0.5%; a steam injection volume of the third line of well rows is 1500-2500 t; injecting the nitrogen with the steam in the whole process, wherein the nitrogen injection volume is calculated according to a gas-to-liquid ratio of the foam formed downhole of 4:1; and after the steam injection is finished, increasing the well soaking time to 6-8 days, and then opening the wells for production.

2. The method for integral profile control and plugging of water encroachment and steam channeling of the heavy oil reservoir with edge and bottom water according to claim 1, characterized in that the high-intensity nitrogen foam system in the step (4) adopts a solid particle reinforced foam system or a high-temperature resistant gel foam system.

3. The method for integral profile control and plugging of water encroachment and steam channeling of the heavy oil reservoir with edge and bottom water according to claim 2, characterized in that a concentration of solid particles in the solid particle reinforced foam system is 0.5%-1%, and the concentration of the foaming agent is 0.5%.

4. The method for integral profile control and plugging of water encroachment and steam channeling of the heavy oil reservoir with edge and bottom water according to claim 3, characterized in that the solid particles in the solid particle reinforced foam system adopt coal ash, clay particles or nano particles.

5. The method for integral profile control and plugging of water encroachment and steam channeling of the heavy oil reservoir with edge and bottom water according to claim 2, characterized in that the high-temperature resistant gel foam system comprises a high-temperature resistant gel plugging agent injected into a stratum and nitrogen foam injected at the same time of cyclic steam stimulation.

6. The method for integral profile control and plugging of water encroachment and steam channeling of the heavy oil reservoir with edge and bottom water according to claim 5, characterized in that the high-temperature resistant plugging agent adopts tanning extracts or temperature-sensitive gel.

7. The method for integral profile control and plugging of water encroachment and steam channeling of the heavy oil reservoir with edge and bottom water according to claim 5, characterized in that an injection amount of the high-temperature resistant gel plugging agent is 30-50 t.

8. The method for integral profile control and plugging of water encroachment and steam channeling of the heavy oil reservoir with edge and bottom water according to claim 5, characterized in that the concentration of the foaming agent in the high-temperature resistant gel foam system is 0.5%.

* * * * *